US011333433B2

(12) United States Patent
Isakov et al.

(10) Patent No.: US 11,333,433 B2
(45) Date of Patent: May 17, 2022

(54) RADIANT COOLER BASED ON DIRECT ABSORPTION AND LATENT HEAT TRANSFER, METHODS OF FORMING AND OPERATING THE SAME

(71) Applicant: Agency for Science, Technology and Research, Singapore (SG)

(72) Inventors: Dmitry Isakov, Singapore (SG); Siew Soon Vong, Singapore (SG); Jun Liang Tan, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 13 days.

(21) Appl. No.: 16/636,871

(22) PCT Filed: Oct. 23, 2018

(86) PCT No.: PCT/SG2018/050523
§ 371 (c)(1),
(2) Date: Feb. 5, 2020

(87) PCT Pub. No.: WO2019/083445
PCT Pub. Date: May 2, 2019

(65) Prior Publication Data

US 2020/0370821 A1 Nov. 26, 2020

(30) Foreign Application Priority Data

Oct. 23, 2017 (SG) ..... 10201708677S

(51) Int. Cl.
*F25D 31/00* (2006.01)
*F28F 13/18* (2006.01)
(Continued)

(52) U.S. Cl.
CPC ..... *F25D 31/00* (2013.01); *F25B 23/003* (2013.01); *F25B 39/022* (2013.01); *F28F 13/18* (2013.01);
(Continued)

(58) Field of Classification Search
CPC ..... F25D 31/00; F25B 23/003; F28F 13/18; F28F 2245/06; F24F 5/0089
See application file for complete search history.

(56) References Cited

U.S. PATENT DOCUMENTS 3,916,871 A 11/1975 Estes et al.
4,085,734 A 4/1978 Gibbs
(Continued)

FOREIGN PATENT DOCUMENTS

JP 2008121999 A * 5/2008 ..... F24S 60/10
WO 2008114266 A2 9/2008
(Continued)

OTHER PUBLICATIONS

University of California Davis, "Residential Radiant Systems: A Potential Solution to Reduce Residential Peak Demand Energy Use," https://wcec.ucdavis.edu/residential-radiant-systems-a-potential-solution-to-residential-peak-demand-energy-use/, 2017, pp. 1-6.
(Continued)

*Primary Examiner* — Lionel Nouketcha
(74) *Attorney, Agent, or Firm* — Winstead PC

(57) ABSTRACT

Various embodiments may relate to a radiant cooler. The radiant cooler may include a chamber. The radiant cooler may also include a vacuum pump connected to the chamber. The radiant cooler may further include an infrared absorber arranged within the chamber. A wall of the chamber may be configured to allow at least a portion of infrared light to pass through. The vacuum pump may be configured to generate a vacuum in the chamber. The infrared absorber may include
(Continued)

a fluid, i.e. a liquid, configured to evaporate into the vacuum upon receiving thermal energy from at least the portion of infrared light.

20 Claims, 10 Drawing Sheets

(51) Int. Cl.
*F25B 23/00* (2006.01)
*F25B 39/02* (2006.01)
*F24F 5/00* (2006.01)

(52) U.S. Cl.
CPC ..... *F24F 5/0089* (2013.01); *F28F 2245/06* (2013.01)

(56) References Cited

U.S. PATENT DOCUMENTS 4,204,521 A * 5/1980 Mattson ..... F24S 80/457 126/658
4,287,882 A 9/1981 Mattson
4,290,412 A * 9/1981 Krauss ..... F24S 10/45 126/596
6,165,326 A * 12/2000 Markopulos ..... B01D 3/007 202/234
7,810,491 B2 10/2010 Benvenuti
8,875,696 B2 * 11/2014 Palmieri ..... F24S 70/65 126/653
2013/0291574 A1 11/2013 Athalye

FOREIGN PATENT DOCUMENTS

WO 2015109155 A2 7/2015
WO 2017151514 A1 9/2017

OTHER PUBLICATIONS

ASHRAE, 2000 ASHRAE Systems and Equipment Handbook, Chapter 6: Panel Heating and Cooling, 2003, pp. 1-20.
Kim et al., "Radiant Heating and Cooling Systems," ASHRAE Journal, Feb. 2015, pp. 28-37.
Morse et al., "A New Approach to Radiant Cooling for Human Comfort," The Journal, Jun. 1961, pp. 181-186.
International Search Report for International Application No. PCT/SG2018/050523 dated Jan. 2, 2019, pp. 1-4.
Written Opinion of the International Searching Authority for International Application No. PCT/SG2018/050523 dated Jan. 2, 2019, pp. 1-4.

* cited by examiner

--PRIOR ART--

FIG. 6C

| | Conventional Radiant cooler | Embodiment |
|---|---|---|
| Absorbing surface temperature, C° | > 15 | < 10 |
| Thermal resistance | >0.1 K/W | 0 |
| Absorption surface | Full panel | Open area in PE support structure (>70%) |
| Reflection losses | <5% | ~10% |
| $Q_{rad}/A$ | <60 W/m$^2$ | > 150 W/m$^2$ * |
| Liquid pumping rate | >L/s | 1 charge per day |
| Infrastructure | Extensive | Add-on panels with max 2 vacuum ports |
| Room air condition | Dependent | Independent |

* prediction

FIG. 6D

| | Solar collection | Conventional Radiant cooling |
|---|---|---|
| Spectrum, μm | 0.25 - 2.5 | 5 - 30 |
| Absorber temperature | > ambient | < ambient >15°C |
| Heat leakage | To environment | From environment |
| Heat transport | Liquid pumping Single phase | Liquid pumping Single phase |
| Vacuum enclosure | Beneficial | Detrimental |

RADIANT COOLER BASED ON DIRECT ABSORPTION AND LATENT HEAT TRANSFER, METHODS OF FORMING AND OPERATING THE SAME

CROSS-REFERENCE TO RELATED APPLICATION

This application claims the benefit of priority of Singapore application No. 10201708677S filed Oct. 23, 2017, the contents of it being hereby incorporated by reference in its entirety for all purposes.

TECHNICAL FIELD

Various aspects of this disclosure relate to a radiant cooler. Various aspects of this disclosure relate to a method of forming a radiant cooler. Various aspects of this disclosure relate to a method of operating a radiant cooler.

BACKGROUND

Radiant cooling refers to the physical process by which a body loses heat to another body of lower temperature via long-wave radiation. Radiant coolers are divided into two main applications: i) infrared (IR) radiation emitter for outdoor applications; and ii) IR radiation collector for indoor applications. The first application relies on radiative exchange with outer space, which is on average is at a temperature of 4K. This allows efficient and practically free heat rejection from the facility.

Indoor radiant collectors have different designs. They may generally be represented by infrared absorbing surfaces inside the indoor space that are kept below ambient temperature. One way to achieve it is to embed a network of water pipes into ceiling, floor or walls. Alternatively, special panels with pipes thermally bonded to them are attached to ceiling or walls. FIG. 1 shows an image of a conventional radiant cooler. In order to reduce temperature, the water is precooled in a dedicated chiller and is pumped at high flow rates.

It may be impractical to have a too high density of pipes. In order to address this, each panel is made preferably of thermally conducting material that allows collection of absorbed heat from relatively large areas into the small diameter pipes. The surface of a panel that is facing the room, is usually covered with a high emissivity coating for efficient IR absorption.

Such implementation has several limitations. Firstly, there is a considerable thermal resistance between absorption surface and water in the pipe. For a tube spacing M, the characteristic panel thermal resistivity $r_u$ (in meter square kelvin per Watt or $m^2$ K/W) may be provided by:

$$r_u = r_t M + r_s M + r_p + r_c \quad (1)$$

wherein $r_t$ represents the thermal resistivity of tube wall per unit tube spacing (in meter kelvin per Watt or mK/W), $r_s$ represents the thermal resistivity between the tube and panel per unit spacing (in meter kelvin per Watt or mK/W), $r_p$ represents the thermal resistivity of panels (in meter square kelvin per Watt or $m^2$ K/W), and $r_c$ represents the thermal resistivity of panel coating (in meter square kelvin per Watt or $m^2$ K/W). The presence of these resistivities puts a limit on overall heat collection capacity of the panel for fixed water temperature.

Secondly, in order to avoid condensation issues, the surface temperature of the cooler would need to be kept at least 2° C. above dew point in the ambient air. For example, at 23° C. and 60% relative humidity (RH), the dew point is 15° C. At the same time, in standard outdoor conditions in Singapore of 28° C. and 80% RH, the dew point is 25° C. Hence, in the first case, the surface temperature of the panel has to be kept at 17° C., while in the second case, it is kept at 27° C. The average temperature of human skin is 34° C. and heat transfer between skin and panel is roughly proportional to temperature difference, which would be 17° C. in the first case and only 7° C. in the second case. This means that heat collection efficiency would drop by 2.4 times. If the dew point temperature limit could be shifted further down, the cooling efficiency of the panel would also increase.

Thirdly, the same dew point consideration also requires thermal insulation of the pipes carrying chilled water. This considerably increases the cost of the system.

Fourthly, radiant exchange is proportional to the absorber area and viewing factor between two bodies. Both factors lead to the requirement of large area absorber, as well as a complex and huge network of pipes typically found in a traditional radiant cooler. This leads to high cost of materials required, aggravated by difficulties in building and maintaining the system.

Fifthly, the system may require both a chiller and a heat rejection unit, both of which are expensive and power hungry.

Sixthly, there is a need for continuous pumping of large volumes of water in order to maintain a low absorber temperature. As such, a conventional unit would require pumping of considerable amount of working fluids up to several litres per second (L/s), and a powerful pump may thus be required. Also, pipes of small diameters are preferred for improved heat transfer, which additionally increases demand on powerful water pumping capacity due to high resistance to flow over the large distance in pipes with small cross-sectional areas.

SUMMARY

Various embodiments may relate to a radiant cooler. The radiant cooler may include a chamber. The radiant cooler may also include a vacuum pump connected to the chamber. The radiant cooler may further include an infrared absorber arranged within the chamber. A wall of the chamber may be configured to allow at least a portion of infrared light to pass through. The vacuum pump may be configured to generate a vacuum in the chamber. The infrared absorber may include a fluid, i.e. a liquid, configured to evaporate into the vacuum upon receiving thermal energy from at least the portion of infrared light.

Various embodiments may provide a method of forming a radiant cooler. The method may include connecting a vacuum pump to a chamber. The method may also include arranging an infrared absorber within the chamber. A wall of the chamber may be configured to allow at least a portion of infrared light to pass through. The vacuum pump may be configured to generate a vacuum in the chamber. The infrared absorber may include a fluid configured to evaporate into the vacuum upon receiving thermal energy from at least the portion of infrared light.

Various embodiments may provide a method of operating a radiant cooler. The method may include activating a vacuum pump connected to a chamber to generate a vacuum in the chamber so that a fluid, the fluid included in an infrared absorber arranged within the chamber, evaporates into the vacuum upon receiving thermal energy from at least a portion of infrared light that is allowed to pass through a wall of the chamber.

BRIEF DESCRIPTION OF THE DRAWINGS

The invention will be better understood with reference to the detailed description when considered in conjunction with the non-limiting examples and the accompanying drawings, in which:

FIG. 6C shows a table comparing various parameters of a conventional radiant cooler and the radiant cooler 600 according to various embodiments.

FIG. 6D is a table comparing solar collection and conventional radiant cooling.

DETAILED DESCRIPTION

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, and logical changes may be made without departing from the scope of the invention. The various embodiments are not necessarily mutually exclusive, as some embodiments can be combined with one or more other embodiments to form new embodiments.

Embodiments described in the context of one of the methods or radiant coolers are analogously valid for the other methods or radiant coolers. Similarly, embodiments described in the context of a method are analogously valid for a radiant cooler, and vice versa.

Features that are described in the context of an embodiment may correspondingly be applicable to the same or similar features in the other embodiments. Features that are described in the context of an embodiment may correspondingly be applicable to the other embodiments, even if not explicitly described in these other embodiments. Furthermore, additions and/or combinations and/or alternatives as described for a feature in the context of an embodiment may correspondingly be applicable to the same or similar feature in the other embodiments.

In the context of various embodiments, the articles "a", "an" and "the" as used with regard to a feature or element include a reference to one or more of the features or elements.

In the context of various embodiments, the term "about" or "approximately" as applied to a numeric value encompasses the exact value and a reasonable variance.

As used herein, the term "and/or" includes any and all combinations of one or more of the associated listed items.

Various embodiments may seek to address the abovementioned issues. Various embodiments may relate to a cooler which involve direct infrared (IR) absorption by a working fluid.

Figure 1:
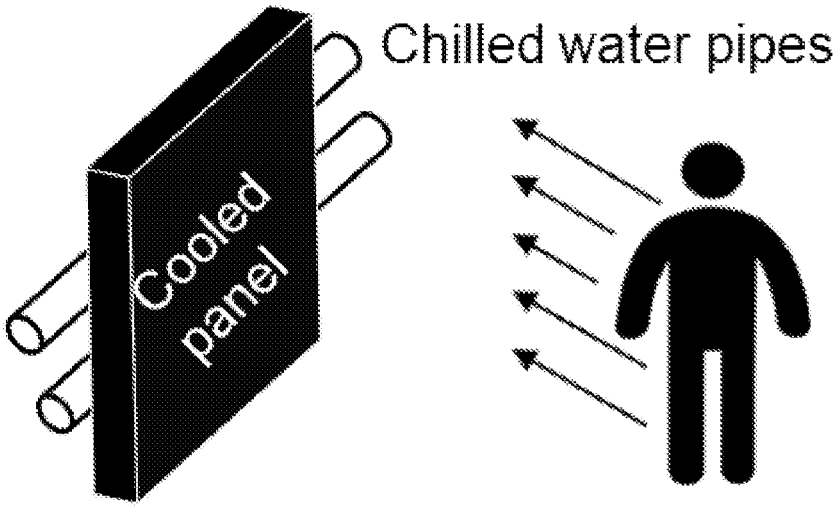
FIG. 1 shows an image of a conventional radiant cooler.
Figure 2:
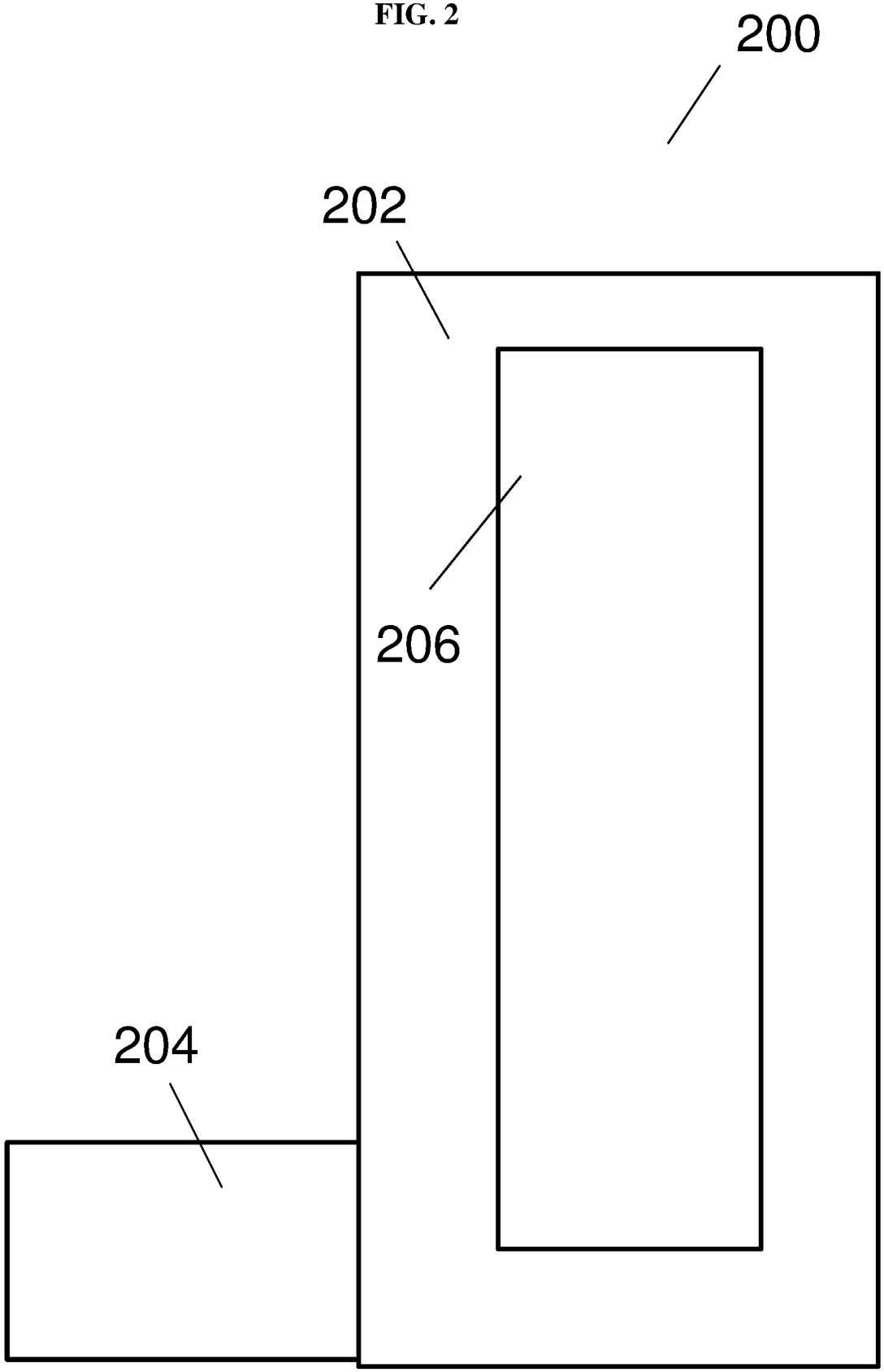
FIG. 2 shows a general illustration of a radiant cooler according to various embodiments.

FIG. 2 shows a general illustration of a radiant cooler 200 according to various embodiments. The radiant cooler 200 may include a chamber 202. The radiant cooler 200 may also include a vacuum pump 204 connected to the chamber 202. The radiant cooler 200 may further include an infrared absorber 206 arranged within the chamber 202. A wall of the chamber 202 may be configured to allow at least a portion of infrared light to pass through. The vacuum pump 204 may be configured to generate a vacuum in the chamber 202. The infrared absorber 206 may include a fluid, i.e. a liquid, configured to evaporate into the vacuum upon receiving thermal energy from at least the portion of infrared light.

In other words, the radiant cooler 200 may include a chamber 202, an infrared absorber 206 included within the chamber 202, as well as a vacuum pump 204 connected to the chamber 202. The vacuum pump 204 may serve to create a vacuum within the chamber 202. The chamber 202 may includes a wall (which may be referred to as a radiation transmissive wall) which is configured so that all or at least some infrared radiation can pass through from the external environment into the chamber 202 (and to the infrared absorber 206). The infrared absorber may include a fluid. The infrared radiation may be absorbed by the fluid, which may then undergo a phase change and evaporate to the vacuum. As such, the radiant cooler 200 may absorb infrared radiation, and thereby provides cooling.

For avoidance of doubt, FIG. 2 serves to illustrate the various components or elements of a radiant cooler 200 according to various embodiments, and is not intended to limit the relative positions, orientation, sizes, or shapes of the radiant cooler 200. For instance, while FIG. 2 shows a vacuum pump connected to a bottom of the chamber 202, the vacuum pump 204 may, for instance, be alternatively connected to a top or middle portion of the chamber 202. While the radiant cooler 200 may be orientated vertically during operation in various embodiments, the radiant cooler 200 may also be oriented laterally during operation in various other embodiments.

The chamber 202 may be defined by one or more walls, of which at least one, i.e. the radiation transmissive wall, is configured to allow at least a portion of infrared light to pass through. In various embodiments, the wall of the chamber 202, i.e. the wall configured to allow at least a portion of infrared light to pass through, may include a film. The wall of the chamber 202 may further include or consist of a support configured to support the film. In various embodiments, the support may include a plurality of bars arranged parallel to one another. The film may be attached or adhered to the plurality of bars via any suitable means, such as adhesive or clips. In various other embodiments, the support may include a plurality of holes. The plurality of holes may extend from a first surface of the support to a second surface of the support opposite the first surface. In various embodiments, the support may be an integral portion of the wall. In various other embodiments, the support may be distinct from the wall but may be joined or attached to the wall via any suitable means.

In various embodiments, the film may be transparent or translucent. The film may be transparent or translucent to at least a wavelength, or a range of wavelengths in the infrared radiation spectrum.

In various embodiments, the film may be thin (e.g. having a thickness below 100 μm), have low permeability for air and water vapour, high transparency to infrared waves (e.g. transparency>80%), and allow large elongation at break (>200%). In various embodiments, the film may be or may include polyethylene (PE). In various other embodiments, any other suitable materials, e.g. nylon, vinyl, polypropylene, may be used.

In various embodiments, the fluid may be water. Water may have advantages such as a high latent heat of evaporation and may be safe in case of panel failure. Water may also remain as liquid in vacuum even if temperature is reduced substantially. In various other embodiments, the fluid may be any other suitable substances such as alcohol or acetone.

In various embodiments, the infrared absorber 206 may be or may include a holder configured to hold the fluid. In various other embodiments, the infrared absorber 206 may be or may include a continuously wetted material such as a porous membrane. The membrane may be made of hydrophilic materials, like cotton or cloth.

In various embodiments, the infrared absorber 206 may be the fluid. In other words, the infrared absorber 206 may consist of only the fluid.

As the fluid evaporates from the infrared absorber 206 into the vacuum, the infrared absorber 206 may be cooled via latent heat transfer associated with the phase change (i.e. from the liquid state to the gas state). In various embodiments, the infrared absorber 206 may be kept or maintained at a temperature below 15° C., e.g. 10° C. In various embodiments, the walls of the chamber 202, i.e. the radiant transmissive wall and the radiation non-transmissive wall, may be substantially equal to the temperature of the environment. The temperature of the environment may be above 15° C., e.g. above 20° C., e.g. above 25° C., e.g. above 30° C. The external surface of the walls may stay thermalized with the external environment, and there may not be condensation on the external surface of the wall. The latent heat of evaporation of water at <30 millibars (mbar) may be 2400 J/g. An evaporation rate of 40 μL/s may be sufficient to remove 100 W.

In various embodiments, the infrared absorber 206 may be suspended or held within the chamber 202. The radiant cooler 200 may include a support structure or arm extending from a wall, e.g. a radiation non-transmissive wall, of the vacuum chamber to suspend or hold the infrared absorber 206.

In various embodiments, the vacuum pump 204 may be further configured to pump or direct the evaporated fluid to an external environment. In the current context, "external environment" may refer to the environment external to the radiant cooler 200.

In various embodiments, additional fluid (i.e. additional fluid may be of the same type as the fluid already contained in the infrared absorber 206) may be provided to the infrared absorber 206 for replacing the evaporated fluid, i.e. the fluid that has evaporated into the vacuum. The additional fluid may be provided to the infrared absorber 206 at a frequency of once a day. Accordingly, the infrared absorber 206 may be continuously maintained with fluid.

In various embodiments, the radiant cooler 200 may further include a feeding pipe. The feeding pipe may extend from the external environment into the chamber 202. The feeding pipe may be configured to supply the additional fluid to the infrared absorber 206.

Figure 3:
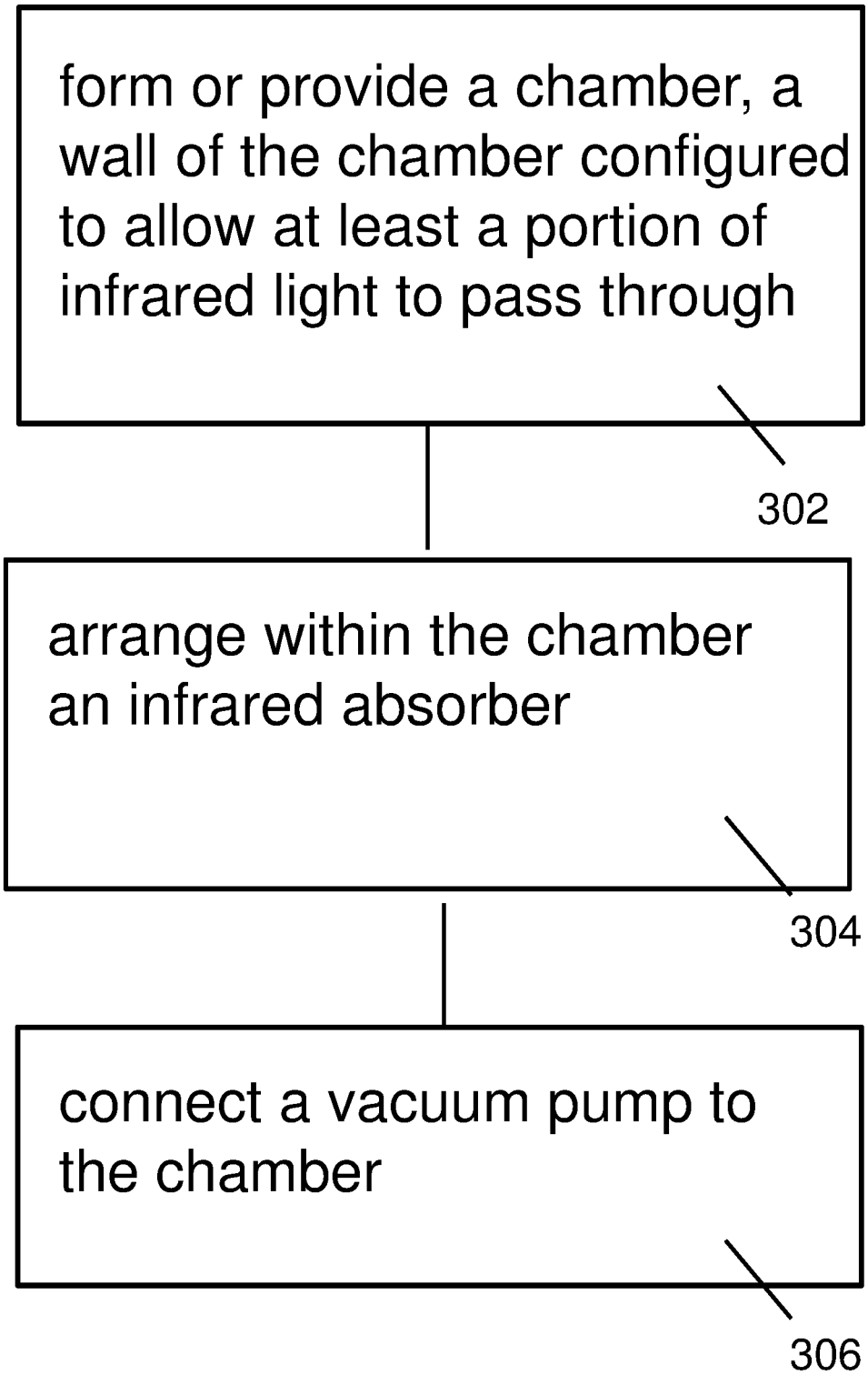
FIG. 3 shows a general illustration of a method of forming a radiant cooler according to various embodiments.

FIG. 3 shows a general illustration of a method of forming a radiant cooler according to various embodiments. The method may include, in 302, forming or providing a chamber, a wall of the chamber configured to allow at least a portion of infrared light to pass through. The method may also include, in 304, arranging within the chamber an infrared absorber. The method may also include, in 306, connecting a vacuum pump to the chamber. The vacuum pump may be configured to generate a vacuum in the chamber. The infrared absorber may include a fluid configured to evaporate into the vacuum upon receiving thermal energy from at least the portion of infrared light.

In other words, forming the radiant cooler may include placing or forming an infrared absorber within the vacuum, and coupling a vacuum pump to the chamber.

For avoidance of doubt, the steps shown in FIG. 3 is not intended to be in sequence. Step 304 may occur before step 306, or may occur after step 306. In various embodiments, step 304 may occur at the same time as step 306.

The method may further include providing or supplying the fluid to the infrared absorber.

The method may also include forming the chamber. In various embodiments, the wall of the chamber, i.e. the wall of the chamber configured to allow at least a portion of infrared light to pass through (alternatively referred to as a radiation transmissive wall), may include a film. The wall of the chamber further comprises a support configured to support the film. The method may include forming the support, and adhering or attaching the film to the support. The method may further include assembling the radiation transmissive wall with one or more other walls, which may be radiation non-transmissive walls, to form the chamber. The radiation non-transmissive walls may be opaque to infrared light.

In various embodiments, the film may be transparent or translucent. The film may include polyethylene (PE).

In various embodiments, the fluid may be water.

In various embodiments, the vacuum pump may be further configured to pump the evaporated fluid to an external environment.

Figure 4:
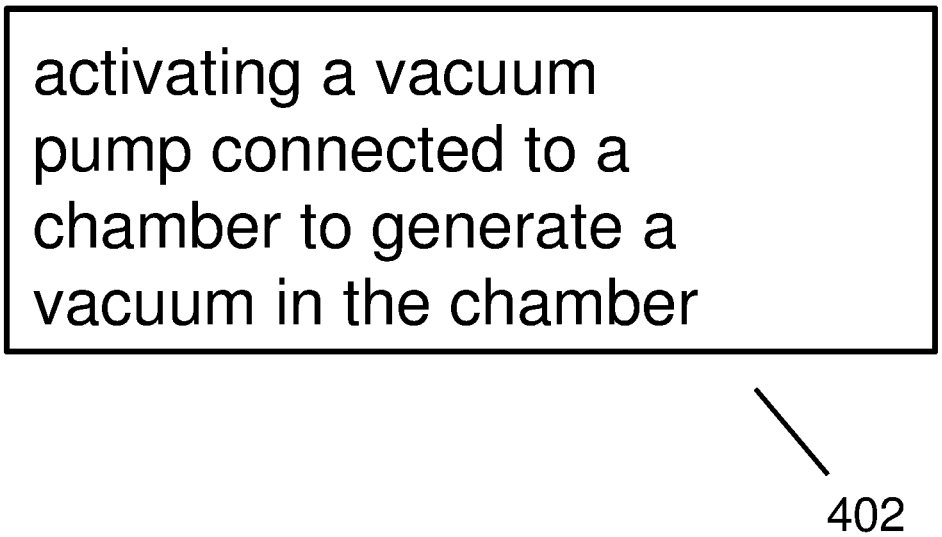
FIG. 4 shows a general illustration of a method of operating a radiant cooler according to various embodiments.

FIG. 4 shows a general illustration of a method of operating a radiant cooler according to various embodiments. The method may include, in 402, activating a vacuum pump connected to a chamber to generate a vacuum in the chamber so that a fluid, the fluid included in an infrared absorber arranged within the chamber, evaporates into the vacuum upon receiving thermal energy from at least a portion of infrared light that is allowed to pass through a wall of the chamber.

In other words, the method may include generating a vacuum. The fluid in the infrared absorber may then absorb infrared radiation from the external environment, and may evaporate directly into the vacuum, thereby providing a cooling effect to the external environment.

In various embodiments, activating a vacuum pump may include switching on the vacuum pump.

In various embodiments, the method may also include exposing the radiant cooler to an infrared source or body that generates or emits the infrared light.

In various embodiments, the wall of the chamber may include a film. The wall of the chamber may further include a support configured to support the film.

The film may be transparent or translucent. The film may include polyethylene (PE).

In various embodiments, the fluid may be water.

In various embodiments, the vacuum pump may be further configured to pump the evaporated fluid to an external environment.

In various embodiments, a temperature of the infrared absorber may be below 15° C., e.g. below 10° C.

In various embodiments, the method may also include providing additional fluid to the infrared absorber for replacing the evaporated fluid.

Figure 5A:
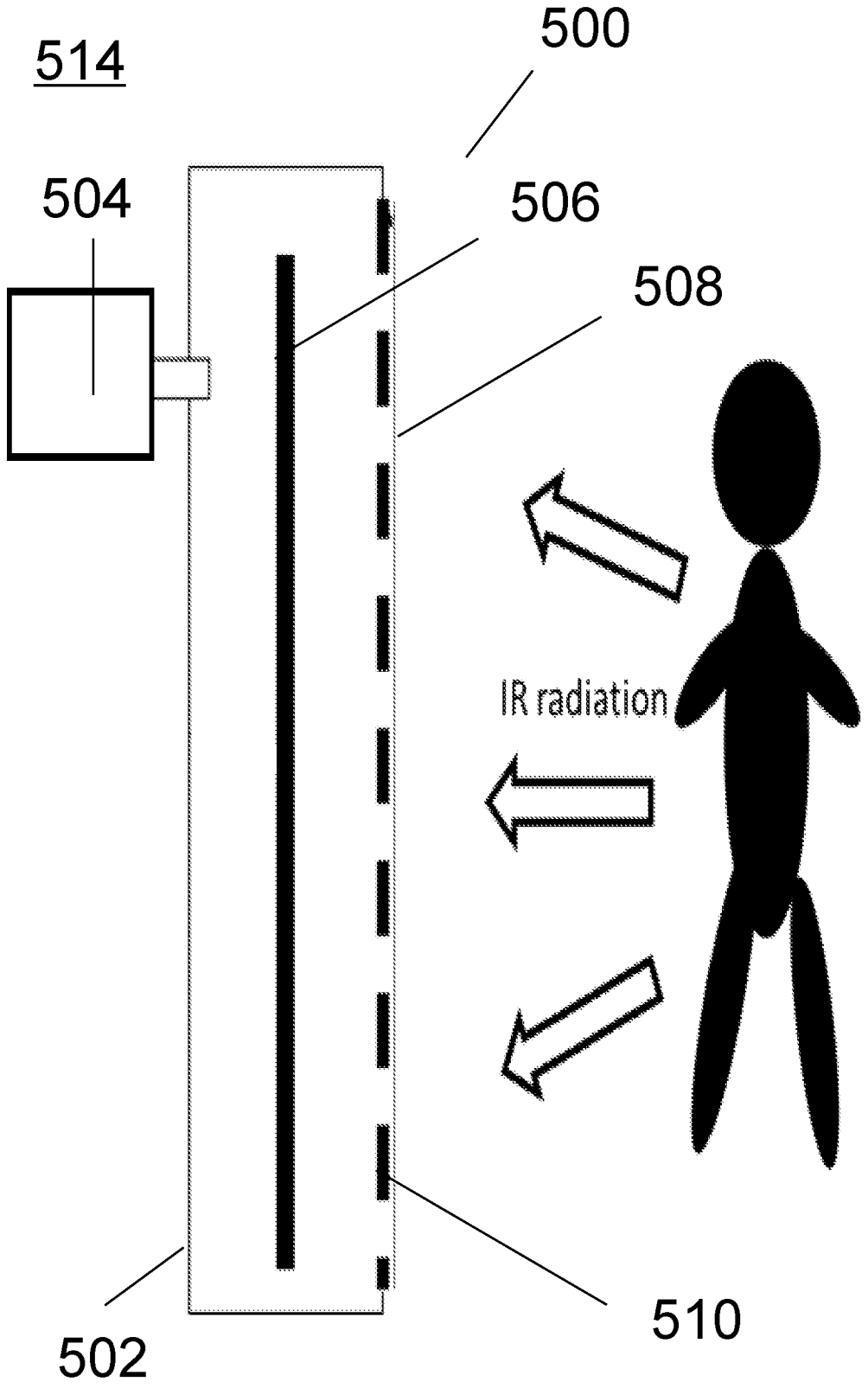
FIG. 5A is a schematic illustrating a radiant cooler according to various embodiments in operation.

FIG. 5A is a schematic illustrating a radiant cooler 500 according to various embodiments in operation. The radiant cooler 500 may include a chamber 502. The radiant cooler 500 may also include a vacuum pump 504 connected to the chamber 502. The radiant cooler 500 may further include an infrared absorber 506 arranged within the chamber 502. At least one wall of the chamber 502, i.e. the radiation transmissive wall or radiation transparent wall, may be configured to allow at least a portion of infrared light to pass through. The vacuum pump 504 may be configured to generate a vacuum in the chamber 502. The radiation transmissive wall may include an infrared transparent film 508, such as a polyethylene (PE) film. PE may be mostly transparent to light from the visible to the infrared (IR) spectral ranges. In addition, PE may have low permeability to most gases. Further, PE may withstand strain of up to 500% before breaking, which allows it to be used as a wall for a vacuum chamber with appropriate support structures. The radiation transmissive wall may also include a rigid support 510. The film 508 may be attached or adhered to the support 510. Other materials or designs may also be possible.

The infrared absorber 506 may include a fluid, i.e. a liquid, configured to evaporate into the vacuum upon receiving thermal energy from at least the portion of infrared light. Water may be used as the fluid as water has strong infrared (IR) absorption, is relatively low cost, non-flammable, has a low impact on the environment, and has a low degradation or deterioration effect on the chamber materials. However, other fluids may also be used.

The position of the absorber 506 may be varied in relation to the radiation transmissive wall in various design considerations.

Figure 5B:
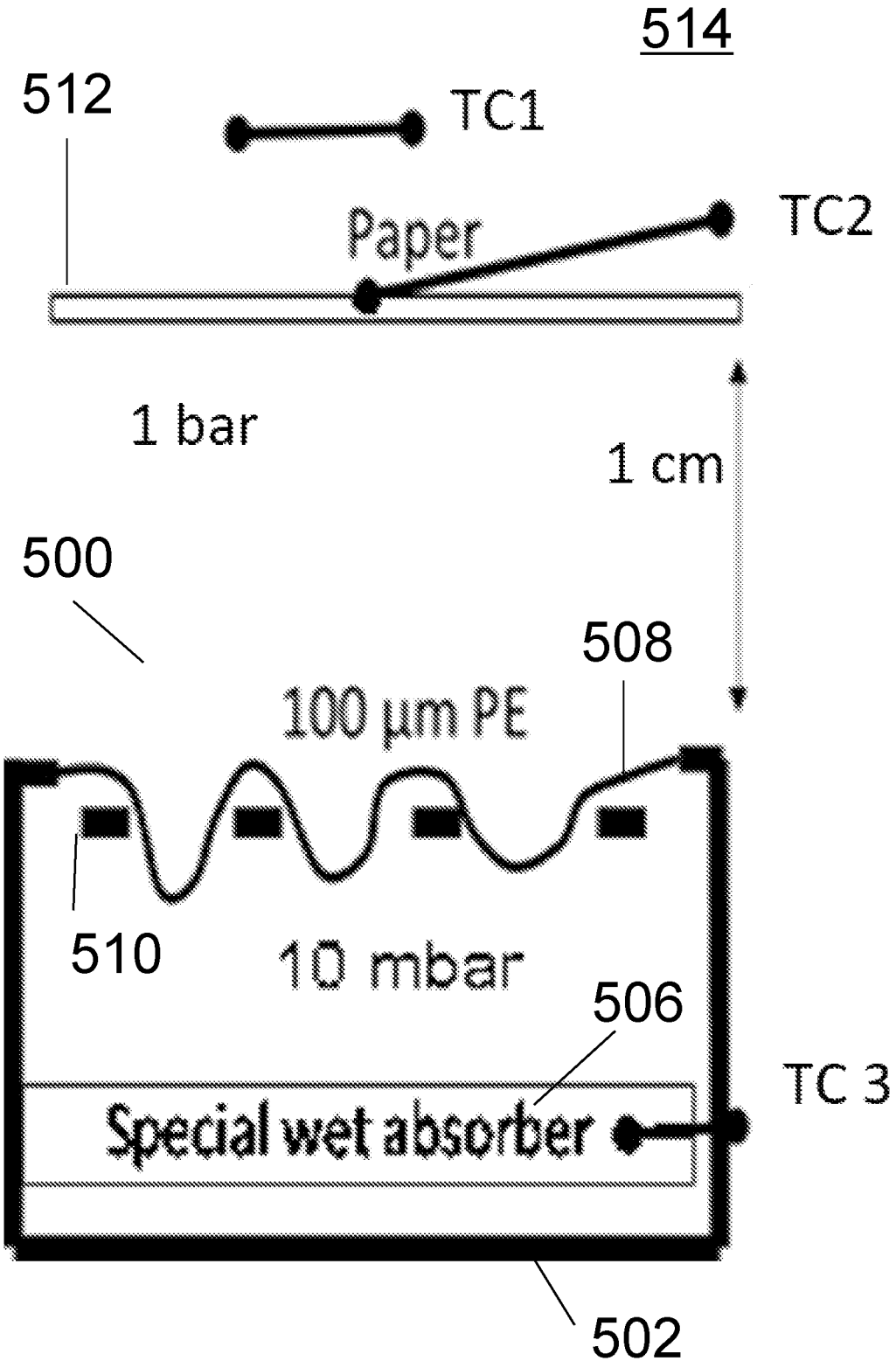
FIG. 5B is a schematic showing a demonstration setup for the radiant cooler according to various embodiments.

FIG. 5B is a schematic showing a demonstration setup for the radiant cooler 500 according to various embodiments. The vacuum pump 504 is not shown in FIG. 5B. The film 508 attached or adhered to the support structure 510 may be deformed due to the difference in pressure within the chamber 502 and the external pressure, i.e. the atmospheric pressure, but retained integrity, thus also maintaining the vacuum within chamber 502. The absorber 506 may include approximately a layer of water on a support thermally insulated from the back wall of the cooler.

The distance between the film 508 and the absorber 506 was about 5 cm. As shown in FIG. 5B, a sheet of paper 512 was placed over the film 508 to cover the entire opening area (i.e. the radiation transmissive wall) of the cooler 500 so that only the radiation from the paper can enter the vacuum chamber 502. The paper 512 was placed about 1 cm above the support 510. A first thermocouple (TC1) was placed in a reference position away from the cooler 500 to monitor the external environmental temperature. A second thermocouple (TC2) was placed on the surface of the paper 512 facing away from the cooler 500, i.e. the surface which is exposed to the external environment 514 so that the second thermocouple is not directly cooled by the absorber 506. A third thermocouple (TC3) was directly immersed into the absorber 506.

Figure 5C:
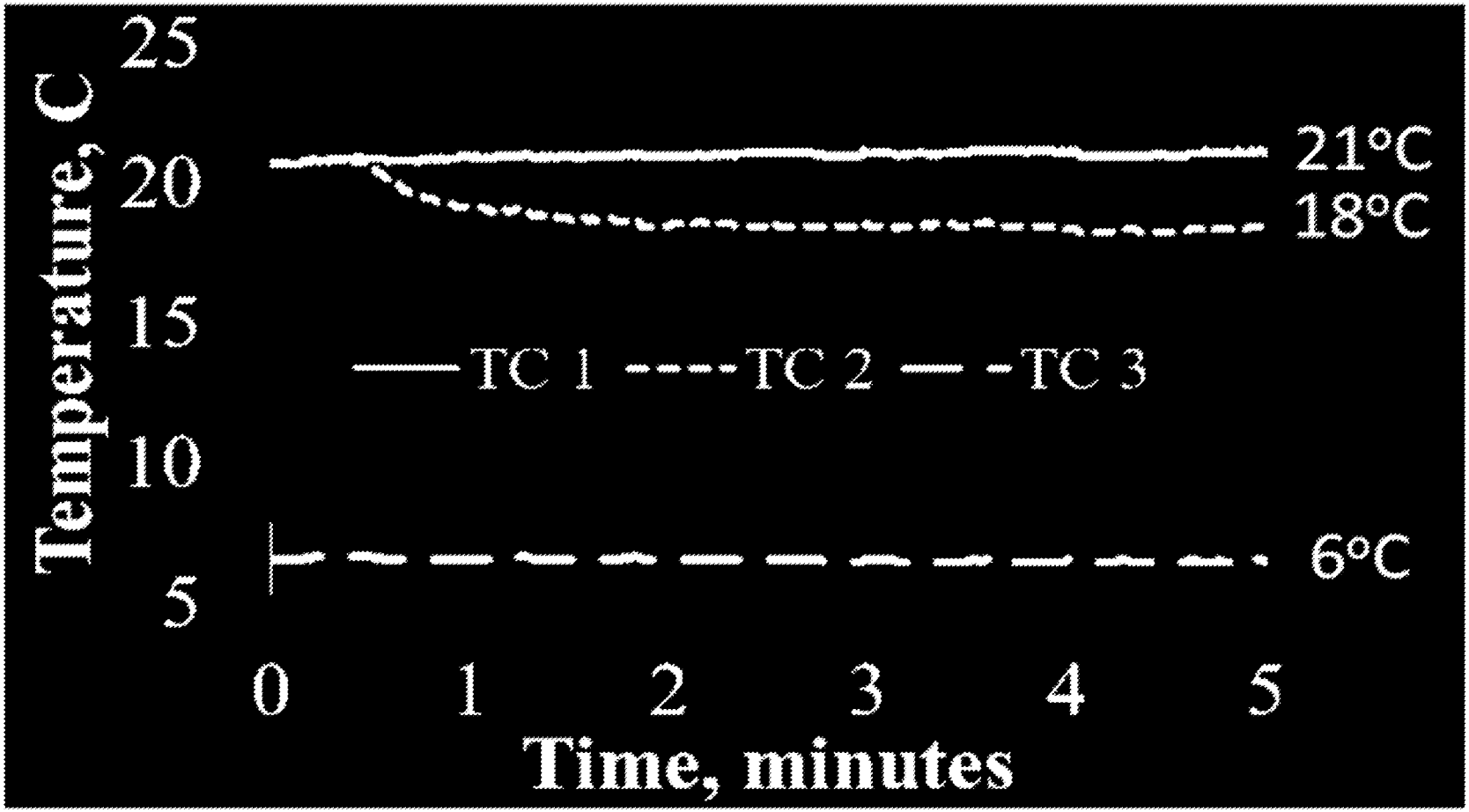
FIG. 5C shows a plot of temperature (in degree Celsius or ° C.) as a function of time (in minutes) illustrating the cooling performance of the radiant cooler according to various embodiments.

FIG. 5C shows a plot of temperature (in degree Celsius or ° C.) as a function of time (in minutes) illustrating the cooling performance of the radiant cooler 500 according to various embodiments. The point at which TC2 shows a sharp drop in temperature corresponds to the moment when the paper 512 is placed in position. The results show that in less than 2 minutes of exposure to the cooler 500, the paper had reached a new thermal equilibrium at 18° C. When the paper 512 is in thermal equilibrium, the heat loss to the absorber 506 is equal to the heat gain form the environment 514, and the temperature of the paper was substantially constant. Temperature of the environment 514 was kept at about 21° C., as shown by the reading of TC1. The temperature of the absorber 506 was kept at about 6° C. shown by FIG. 5C. Low temperature was maintained by continuous evaporation of water and removal of generated vapour by vacuum pump. The experiment continued for 35 minutes without appreciable change to the temperature of the paper.

The fundamental limit for PE film area may be estimated through its permeability at proposed pressure differences at a thickness of 100 um with a continuous pump rate of 5.9 $m^3/h$ (pump rate of vacuum pump). For a 100 um thick PE film, the limit may be around 2400 $m^2$, making the concept easily scalable. In various embodiments, the radiation transmissive wall may have an area of around or less than 2400 $m^2$.

The amount of water to be replaced in the absorber may also be estimated. It may be assumed that a 3 m by 3 m room generates a heat input in the range of 300 W (from about 3 people). If all this heat input is absorbed by the radiant cooler in a 12-hours working day, the amount of water that has to evaporate using latent heat of vaporization at 10 mbar (which may be equal to 2400 kJ/L) may be just 5.4 L. For an absorber covering the whole ceiling, it may mean that required water layer thickness be about 600 μm. This may be still longer than the IR absorption length in water, which may be below 10 μm for wavelengths in the long IR range (wavelengths above 7 μm). A standard vacuum pump may be used. A low pressure vacuum pump may alternatively be used for improved energy efficiency.

Various embodiments may relate to a radiant cooler with a cooled absorber surface separated from the external environment by an infrared transparent layer and a vacuum cavity.

Various embodiments may relate to a radiant cooler which involves direct infrared radiation or wavelengths absorption directly in the working fluid or liquid.

In various embodiments, the radiant cooler may involve heat removal from the absorber by direct evaporation into the vacuum.

The water molecules may be evacuated from the cavity by means of a standard vacuum pump. The exhaust of the pump may directly reject water molecules to outside of the building. As such, there may be no need for a separate heat rejecter, like a cooling tower.

Figure 6A:
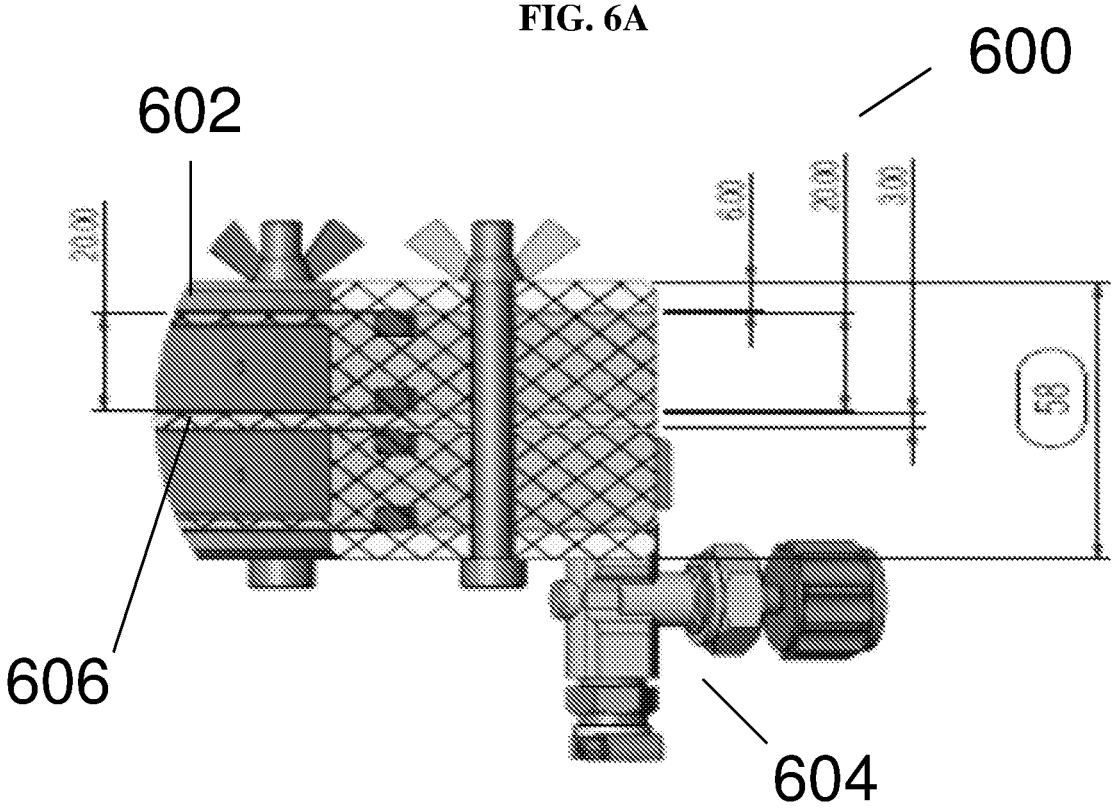
FIG. 6A shows a cross-section side view of a radiant cooler according to various embodiments.
Figure 6B:
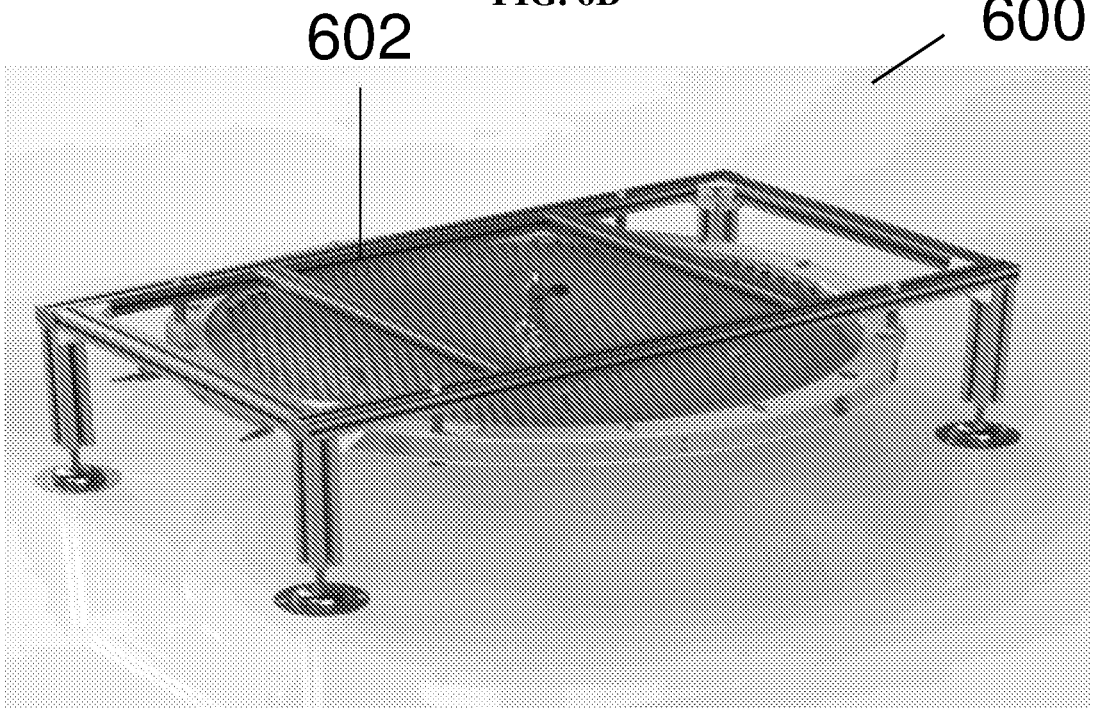
FIG. 6B shows a perspective view of the radiant cooler according to various embodiments.

FIG. 6A shows a cross-section side view of a radiant cooler 600 according to various embodiments. FIG. 6B shows a perspective view of the radiant cooler 600 according to various embodiments. The radiant cooler 600 may include a chamber 602, a vacuum pump 604 connected to the chamber 602, and an absorber 606 arranged within the chamber 602. The chamber 602 may be a panel. The absorber 606 may be directly exposed to infrared radiation through the transparent chamber walls. The absorber 606 may include a liquid that almost instantaneously release the absorbed heat through phase change (i.e. evaporation) at relevant temperatures and vacuum pressures. The heat collected by the radiant cooling panel 602 may be continuously removed from the panel 602 by pump liquid vapor to the outside environment.

FIG. 6C shows a table comparing various parameters of a conventional radiant cooler and the radiant cooler 600 according to various embodiments. FIG. 6D is a table comparing solar collection and conventional radiant cooling.

Various embodiments may provide a radiant cooler in which infrared (IR) radiation is directly absorbed in working fluid and thus, there is no limit on cooling efficiency imposed by thermal resistivity.

Various embodiments may provide a radiant cooler in which IR absorber is placed inside vacuum chamber that thermally insulates the absorber from chamber walls, thus preserving the temperature of the walls at ambient conditions, which are above dew point.

Various embodiments may provide a radiant cooler in which the working fluid is cooled by latent heat transfer (direct evaporation into vacuum), which removes a need for continuous pumping of large quantities of chilled water.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A radiant cooler comprising:

a chamber;

a vacuum pump connected to the chamber; and an infrared absorber arranged within the chamber;

wherein a wall of the chamber is configured to allow at least a portion of infrared light to pass through;

wherein the vacuum pump is configured to generate a vacuum in the chamber; and wherein the infrared absorber comprises a fluid configured to evaporate into the vacuum upon receiving thermal energy from at least the portion of infrared light, such that evaporation of the fluid into the vacuum cools the infrared absorber via latent heat transfer associated with a phase change of the fluid from a liquid state to a gas state; and wherein the vacuum pump is further configured to pump the evaporated fluid in the chamber to an environment external to the radiant cooler.

2. The radiant cooler according to claim 1, wherein the wall of the chamber comprises a film; and wherein the wall of the chamber further comprises a support configured to support the film.

3. The radiant cooler according to claim 2, wherein the film is transparent.

4. The radiant cooler according to claim 2, wherein the film comprises polyethylene (PE).

5. The radiant cooler according to claim 1, wherein the fluid is water.

6. The radiant cooler according to claim 1, wherein the fluid is configured to evaporate into the vacuum upon receiving the thermal energy from long infrared waves having wavelengths above 7 μm and below 10 μm.

7. A method of forming a radiant cooler, the method comprising:

forming a chamber, a wall of the chamber configured to allow at least a portion of infrared light to pass through; and arranging within the chamber an infrared absorber; and connecting a vacuum pump to the chamber;

wherein the vacuum pump is configured to generate a vacuum in the chamber; and wherein the infrared absorber comprises a fluid configured to evaporate into the vacuum upon receiving thermal energy from at least the portion of infrared light, such that evaporation of the fluid into the vacuum cools the infrared absorber via latent heat transfer associated with a phase change of the fluid from a liquid state to a gas state; and wherein the vacuum pump is further configured to pump the evaporated fluid in the chamber to an external environment.

8. The method according to claim 7, wherein the wall of the chamber comprises a film; and wherein the wall of the chamber further comprises a support configured to support the film.

9. The method according to claim 8, wherein the film is attached to the support.

10. The method according to claim 8, wherein the film is transparent.

11. The method according to claim 7, further comprising:

providing the fluid to the infrared absorber.

12. The method according to claim 7, wherein the fluid is configured to evaporate into the vacuum upon receiving the thermal energy from long infrared waves having wavelengths above 7 μm and below 10 μm.

13. A method of operating a radiant cooler, the method comprising:

activating a vacuum pump connected to a chamber to generate a vacuum in the chamber so that a fluid, the fluid comprised in an infrared absorber arranged within the chamber, evaporates into the vacuum upon receiving thermal energy from at least a portion of infrared light that is allowed to pass through a wall of the chamber, such that evaporation of the fluid into the vacuum cools the infrared absorber via latent heat transfer associated with a phase change of the fluid from a liquid state to a gas state;

wherein the vacuum pump is further configured to pump the evaporated fluid in the chamber to an environment external to the radiant cooler.

14. The method according to claim 13, wherein the wall of the chamber comprises a film;

wherein the wall of the chamber further comprises a support configured to support the film.

15. The method according to claim 14, wherein the film is transparent.

16. The method according to claim 14, wherein the film comprises polyethylene (PE).

17. The method according to claim 13, wherein the fluid is water.

18. The method according to claim 13, wherein a temperature of the infrared absorber is below 15° C.

19. The method according to claim 13, further comprising:

providing additional fluid to the infrared absorber for replacing the evaporated fluid.

20. The method according to claim 13, wherein the fluid is configured to evaporate into the vacuum upon receiving the thermal energy from long infrared waves having wavelengths above 7 μm and below 10 μm.

* * * * *